US007281641B2

(12) United States Patent
Apps

(10) Patent No.: US 7,281,641 B2
(45) Date of Patent: Oct. 16, 2007

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1065 days.

(21) Appl. No.: 09/891,948

(22) Filed: Jun. 25, 2001

(65) Prior Publication Data

US 2002/0195452 A1 Dec. 26, 2002

(51) Int. Cl.
*B65D 21/032* (2006.01)

(52) U.S. Cl. ..... 220/516; 206/509

(58) Field of Classification Search ..... 206/509; 220/509, 516

See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,512,855 | A | 6/1950 | Erickson |
| 2,526,335 | A | 10/1950 | Deichert |
| 2,530,481 | A | 11/1950 | Rawn, Jr. |
| 2,535,493 | A | 12/1950 | Gerber |
| 2,588,805 | A | 3/1952 | Cross |
| 2,626,079 | A | 1/1953 | Keller |
| D172,664 | S | 7/1954 | Emery |
| 2,743,030 | A | 4/1956 | Read, Jr. |
| 2,840,256 | A | 6/1958 | Cobb, Jr. |
| 2,928,530 | A | 3/1960 | Sauey |
| 2,935,222 | A | 5/1960 | O'Connell |
| 2,970,715 | A | 2/1961 | Kappel et al. |
| D189,891 | S | 3/1961 | Schiling |
| 2,979,222 | A | 4/1961 | Levine |
| 3,009,579 | A | 11/1961 | Ettlinger, Jr. |
| 3,055,531 | A | 9/1962 | Chelbor |
| 3,055,542 | A | 9/1962 | Russo |

(Continued)

FOREIGN PATENT DOCUMENTS

| | | |
|---|---|---|
| BE | 680197 | 10/1966 |

(Continued)

OTHER PUBLICATIONS

Exhibit 1: Four photos of a prior art case of Rehrig Pacific Company, Model No. PLBC-8-2L-PET-QD (1984).

Exhibit 2: Two photos of a prior art case of Rehrig Pacific Company for 3 liter PET bottles (1990).

Exhibit 3: Two photos of a prior art case of D.W. Plastics (Date unknown).

Exhibit 4: Two photos of a prior art case of International Container Systems, Inc. for 3 liter PET bottles (Date unknown).

*Primary Examiner*—Stephen J. Castellano

(57) ABSTRACT

A low depth tray for bottles is provided which includes a first pair of opposed walls, a second pair of opposed walls attached to the first pair of opposed walls to form a wall structure, a base attached to the wall structure, and a plurality of interior divider walls extending upwardly from the base. At least one member projects upwardly from an interior of the wall structure and is connected to the divider walls, where the interior member has a height less than the height of the wall structure and less than the height of bottles loaded in the tray. Together, the interior member, the base, the divider walls, and the wall structure define a plurality of bottle retaining pockets which are each sized to receive a single bottle therein.

36 Claims, 9 Drawing Sheets

U.S. PATENT DOCUMENTS 3,092,284 A 6/1963 Stout
D195,702 S 7/1963 Russo
3,148,797 A 9/1964 Cloyd
3,151,762 A 10/1964 Vidal
3,155,268 A 11/1964 Fogerty et al.
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher et al.
3,333,729 A 8/1967 Rabb
3,334,767 A 8/1967 Cornelius et al.
3,349,943 A 10/1967 Box
D209,864 S 1/1968 Versteeg
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Schoeller
3,517,852 A 6/1970 Schoeller
3,638,824 A 2/1972 Sekiguchi et al.
3,701,449 A 10/1972 Schoeller
3,759,416 A 9/1973 Constantine
D229,674 S 12/1973 Quigg
3,812,996 A 5/1974 Bunnell
3,865,239 A 2/1975 Herolzer et al.
3,949,876 A 4/1976 Bridges et al.
3,998,327 A 12/1976 Box
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,319,685 A 3/1982 David
4,344,530 A 8/1982 deLarosiere
D266,709 S 10/1982 Box
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Cushing et al.
D284,841 S 7/1986 Rowland et al.
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,848,580 A 7/1989 Wise
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,978,002 A 12/1990 Apps et al.
D313,493 S 1/1991 Apps et al.
D317,670 S 6/1991 Apps
D318,552 S 7/1991 Apps
5,031,774 A 7/1991 Morris et al.
D319,129 S 8/1991 Apps et al.
D320,298 S 9/1991 Apps et al.
5,060,819 A 10/1991 Apps
5,071,026 A 12/1991 Apps
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,305,884 A 4/1994 Apps et al.
5,316,172 A 5/1994 Apps et al.
5,335,814 A 8/1994 Hepp
D350,438 S 9/1994 Apps et al.
5,421,477 A 6/1995 Hammett
D360,758 S 8/1995 Umiker
D361,431 S 8/1995 Koefelda
5,465,843 A 11/1995 Koefelda
5,487,487 A 1/1996 Hammett
5,501,352 A 3/1996 Apps
5,529,176 A 6/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,704,482 A 1/1998 Apps et al.
D399,060 S 10/1998 Apps et al.
D400,012 S 10/1998 Apps
5,823,376 A 10/1998 McGrath
5,842,572 A 12/1998 Apps et al.
D404,204 S 1/1999 Apps
5,855,277 A 1/1999 Apps et al.
D410,778 S 6/1999 Apps et al.
D412,399 S 8/1999 Apps et al.
5,964,343 A 10/1999 Steiner
5,979,654 A 11/1999 Apps
D417,784 S 12/1999 Umiker
6,006,912 A 12/1999 McGrath
D420,220 S 2/2000 Apps et al.
6,047,844 A 4/2000 McGrath
6,073,793 A 6/2000 Apps et al.
6,079,554 A 6/2000 Hammett et al.

FOREIGN PATENT DOCUMENTS

BE 693216 7/1967
CA 965056 3/1975
CA 1109433 9/1981
DE 1207268 12/1965
EP 0 099 827 10/1986
EP 0 210 712 8/1990
EP 1 008 527 A1 6/2000
FR 1285689 1/1962
FR 1350962 12/1963
FR 1351218 12/1963
FR 1518610 2/1968
FR 2302244 9/1976
GB 943947 12/1963
GB 1032916 6/1966
GB 1115343 5/1968
GB 1120067 7/1968
GB 1152038 5/1969
GB 1312701 4/1973
GB 1319726 6/1973
GB 1330778 9/1973
GB 2 079 256 A 1/1982

| | | | | | |
|---|---|---|---|---|---|
| GB | 2 135 278 A | 8/1984 | WO | WO 82/01536 | 5/1982 |
| GB | 2158044 A | 11/1985 | WO | WO 98/07636 | 2/1998 |
| NE | 6505562 | 10/1966 | WO | WO 00/41937 | 7/2000 |

STACKABLE LOW DEPTH TRAY

BACKGROUND OF THE INVENTION

1. Field of the Invention

This invention relates to a stackable low depth tray for storing and transporting beverage containers, such as bottles.

2. Background Art

Bottles, particularly for soft drinks and other beverages, are often stored and transported in trays. The term "tray" as used herein includes trays, crates, cases, and similar containers having a floor and a peripheral side wall structure. As compared with other materials, plastic trays provide advantages such as strength, durability, and reusability. In order to minimize the storage space of trays, reduce their cost and weight, and promote display of the bottles contained therein, many trays are constructed to have shallow side and end walls. Such trays are generally referred to as "low depth" trays in which the side and end walls are lower than the height of the stored bottles, and in which the bottles support the weight of additional trays stacked on top.

In general, bottles go through a bottling facility and to the bottler's warehouse in the following order: the bottles are filled, sealed, loaded into trays, and then layers of trays are placed on pallets. Trays in successive layers are stacked or cross-stacked on top of each other, with the bottles bearing most of the load of above-stacked trays. The stacks of trays must be particularly stable in order to remain standing during the jostling inherent when the pallets are moved into and out of the warehouse.

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear relatively high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along its symmetric axis. However, if a compressive load is applied to a conventional PET beverage bottle along a direction other than the symmetry axis of the bottle, the bottle may buckle, particularly for large capacity bottles such as the two-liter bottle widely used for marketing soft drinks.

Bottles can also tilt away from vertical alignment upon stacking if conventional partitioned trays having low side walls are used to contain the bottles. Tilted bottles in the lower trays of a stack can buckle, causing the stack to fall. Even absent buckling, the tendency of bottles to tilt in conventional low-sided trays causes instability and places an undesirably low limit on the number of tiers that can be included in a stack.

With the aforementioned issues regarding bottle stability and storage and handling processes in mind, there are several features which are desirable for the design of low depth bottle trays. Generally, low depth trays should have a wall structure that provides sufficient support for the bottles stored therein while also allowing the bottles to be visible for merchandising purposes. In addition, trays should be designed with structural features which enhance their stability when stacked and cross-stacked. Still further, the trays should have sufficient strength and rigidity to withstand shipping and handling. Lastly, the trays should be lightweight, easy to manipulate and carry, and efficient to mold.

Current low depth trays are typically designed with a trade-off between strength and weight, wherein material is often removed to decrease weight, thus reducing structural integrity or bottle stability. Also, many low depth trays are inefficient to mold, typically due to the design of bottle support members which extend upwardly from and within the low side walls. Long mold times render trays susceptible to uneven cooling, which can cause warping and dimensional inaccuracies as well as possibly decreasing the life of the tray.

SUMMARY OF THE INVENTION

Therefore, it is an object according to the present invention to provide an improved low depth tray for storing, transporting, and displaying beverage containers, such as bottles.

It is another object according to the present invention to provide a low depth tray which is designed to have a decreased weight without compromising the structural integrity of the tray and the stability of the bottles loaded therein.

It is yet another object according to the present invention to provide a low depth tray which can be more efficiently molded allowing for faster and more even cooling of the tray.

Accordingly, a low depth tray for bottles is provided which includes a first pair of opposed walls, a second pair of opposed walls attached to the first pair of opposed walls to form a wall structure, a base attached to the wall structure, and a plurality of interior divider walls extending upwardly from the base. At least one member, or column, projects upwardly from an interior of the wall structure and is connected to the divider walls, where the interior member has a height less than the height of the wall structure and less than the height of bottles loaded in the tray. Together, the interior member, the base, the divider walls, and the wall structure define a plurality of bottle retaining pockets which are each sized to receive a single bottle therein.

The wall structure includes an upper wall portion having a plurality of upwardly projecting wall members, or pylons, and a plurality of windows formed therein between the pylons. More specifically, the pylons include wall pylons disposed along the first pair of opposed walls and four corner pylons disposed at the intersection of adjacent walls. The pylons preferably extend a distance above the base of approximately 40% of the height of bottles loaded in the tray, and the columns preferably have a height of approximately 75% of the height of the pylons. Each pylon includes at least one curved surface contoured to the shape of bottles loaded in the tray, and each interior column is generally octagonal and includes curved surfaces disposed on alternating sides thereof which are contoured to the shape of bottles loaded in the tray. In a preferred embodiment, the pylons and the columns also each include an opening adjacent the base on the curved surfaces thereof.

The wall structure has a double-walled construction and includes a lower wall portion having a substantially flat outer wall and a generally curved inner wall contoured to the shape of bottles loaded in the tray. The bottle retaining pockets are preferably sized to receive two-liter bottles.

Each of the second pair of opposed walls includes a handle structure, where each handle structure includes an upper bar extending between adjacent corner pylons, a lower support member connected to the corner pylons and the base, and a slot defined therebetween. Advantageously, a user's fingers can be inserted through the slot and under the upper bar in a palm-up orientation, and over the upper bar and through the slot in palm-down orientation. The upper bar and the corner pylons are substantially equal in height, and the upper bar is outwardly offset from the corner pylons.

The lower support member includes a generally horizontal portion which is connected to the corner pylons and extends inwardly into the tray, and a generally vertical portion which extends downwardly from the horizontal portion to join with the base. The horizontal portion includes curved surfaces which are contoured to the shape of bottles loaded in the tray and form part of bottle retaining pockets located adjacent the second pair of opposed walls.

The base includes an upper surface including a plurality of spaced bottle support areas joined to the first pair of opposed walls and the divider walls. Each bottle support area is generally circular, preferably includes apertures formed therein, and forms part of one bottle retaining pocket. The base also includes a lower surface which has a plurality of upwardly recessed closure receiving areas generally opposing the bottle support areas. Preferably, the receiving areas each have a downwardly extending, generally cloverleaf-shaped periphery configured to receive and retain bottle closures therein.

The pylons and interior columns are substantially hollow to allow for stacking of empty trays. In addition, according to a preferred embodiment, the pylons are tapered from bottom to top and are angled slightly toward the interior of the tray to facilitate stacking. Furthermore, the wall pylons each include a downwardly extending recess formed therein, and the interior columns include a downwardly extending transverse recess substantially aligned with the recesses in adjacent wall pylons, and a downwardly extending longitudinal recess extending along a longitudinal axis of the tray. The depth of the column recesses is substantially equal to the depth of the pylon recesses.

Correspondingly, a plurality of pylon support ribs extend upwardly from the base lower surface to join with each pylon recess, and a plurality of column support ribs extend upwardly from the base lower surface to join with the transverse and longitudinal column recesses. When the tray is empty and is disposed in a stacked configuration with a like upper tray, the pylon recesses of the tray are adapted to receive the corresponding pylon ribs of the like upper tray and the column recesses of the tray are adapted to receive the corresponding column ribs of the like upper tray, such that at least a portion of the pylons and columns of the tray are received in the pylons and columns, respectively, of the like upper tray.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 8:
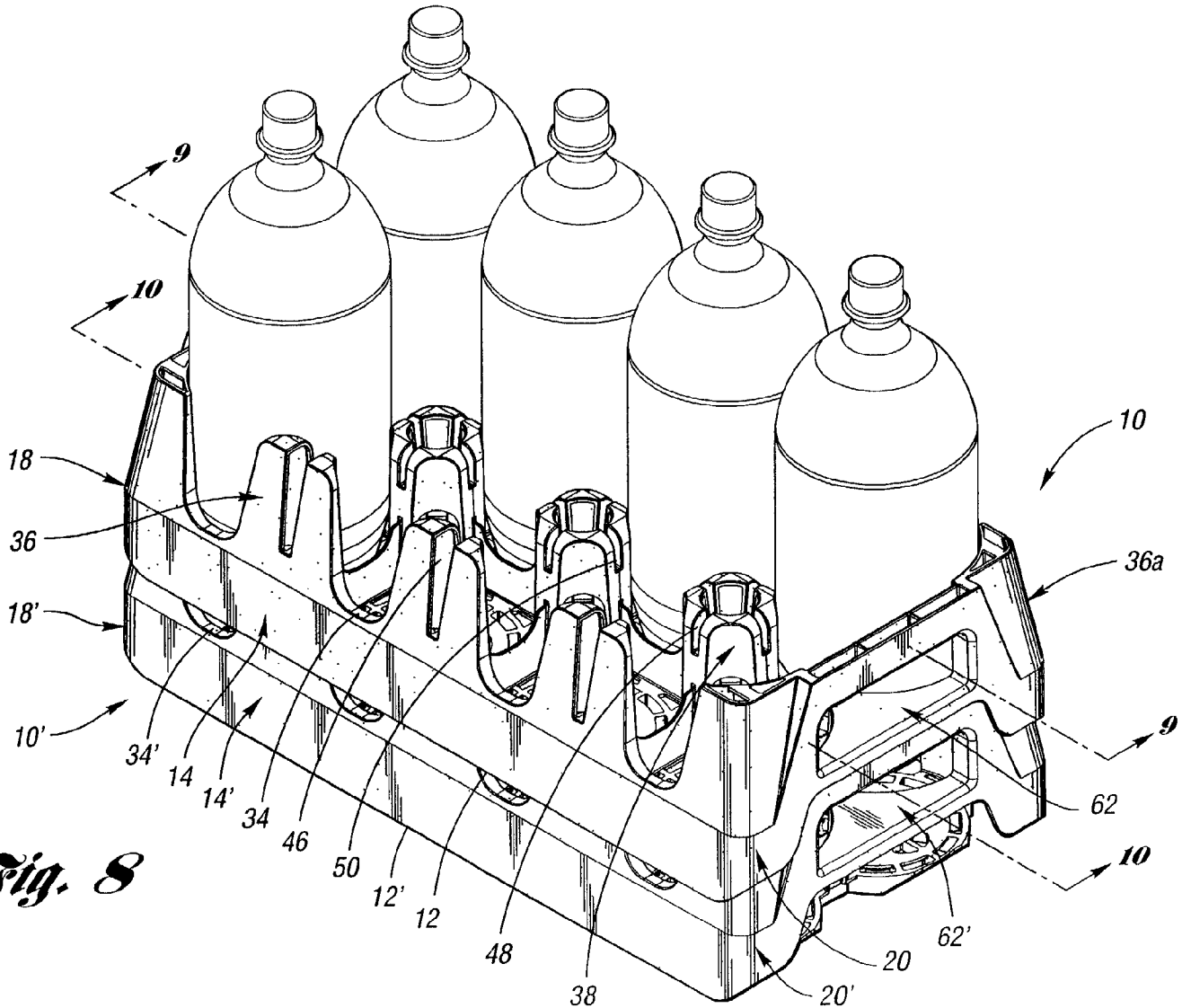
FIG. 8 is a perspective view of the tray of FIG. 1 disposed in a stacked configuration with a like tray and loaded with several bottles.

FIGS. 1-5 show several views of a low depth tray 10 according to the present invention. While tray 10 is suited for many uses, tray 10 is particularly suitable for storing and transporting bottles B (see FIG. 8). Tray 10 includes a base 12 or floor member (best shown in FIGS. 2-3), a first pair of opposed walls 14, 16, and a second pair of opposed walls 18, 20. For convenience, and without additional limitation, first pair of opposed walls 14, 16 will be referred to herein as side walls, and second pair of opposed walls 18, 20 will be referred to herein as end walls. Side walls 14, 16 and end walls 18, 20 are attached to each other to form a wall structure, and are attached to base 12 and extend upwardly therefrom. Preferably, side walls 14, 16, end walls 18, 20, and base 12 form an integral, unitary member of one-piece construction. Tray 10 is generally symmetric about a longitudinal axis 22 and a transverse axis 24 thereof (see FIG. 2). As shown in FIG. 8, the depth or height of side walls 14, 16 and end walls 18, 20 is relatively low compared to the height of the bottles retained in tray 10.

Tray 10 is typically formed of various types of plastic or polymeric materials, such as high density polyethylene (HDPE), by an injection molding or other plastic molding process suitable to this application. As is well understood in the art, the wall thickness of base 12, walls 14, 16, 18, 20, and other components illustrated and disclosed herein may vary depending on the intended usage and other characteristics desired from tray 10. In the embodiment shown herein, tray 10 is rectangular having side walls 14, 16 which are relatively longer than end walls 18, 20. However, tray 10 of the present invention is not limited to a rectangular shape and may include side walls 14, 16 and end walls 18, 20 of equal length forming a tray 10 of square dimensions.

Figure 1:
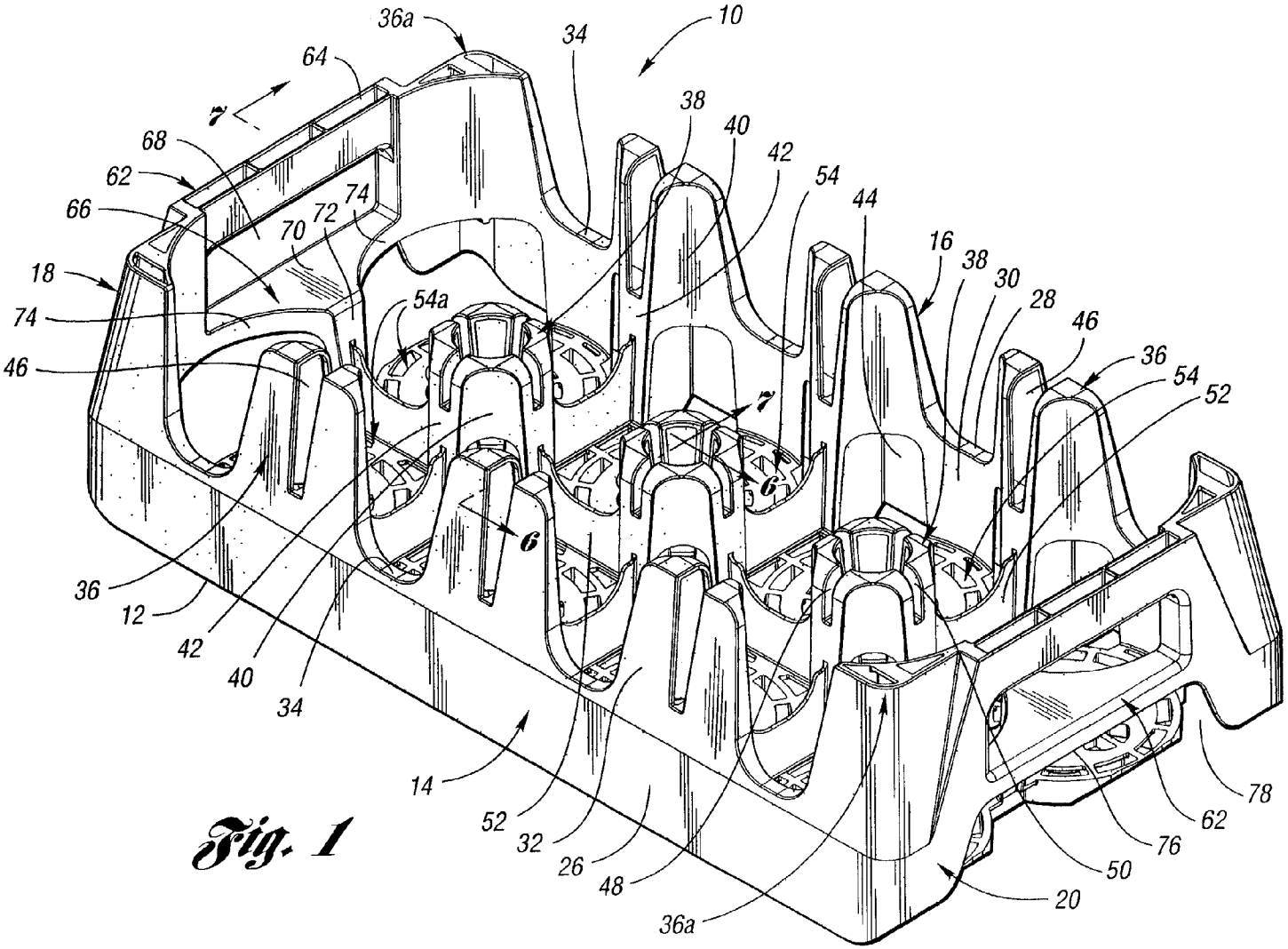
FIG. 1 is a perspective view of a stackable low depth tray according to the present invention.
Figure 2:
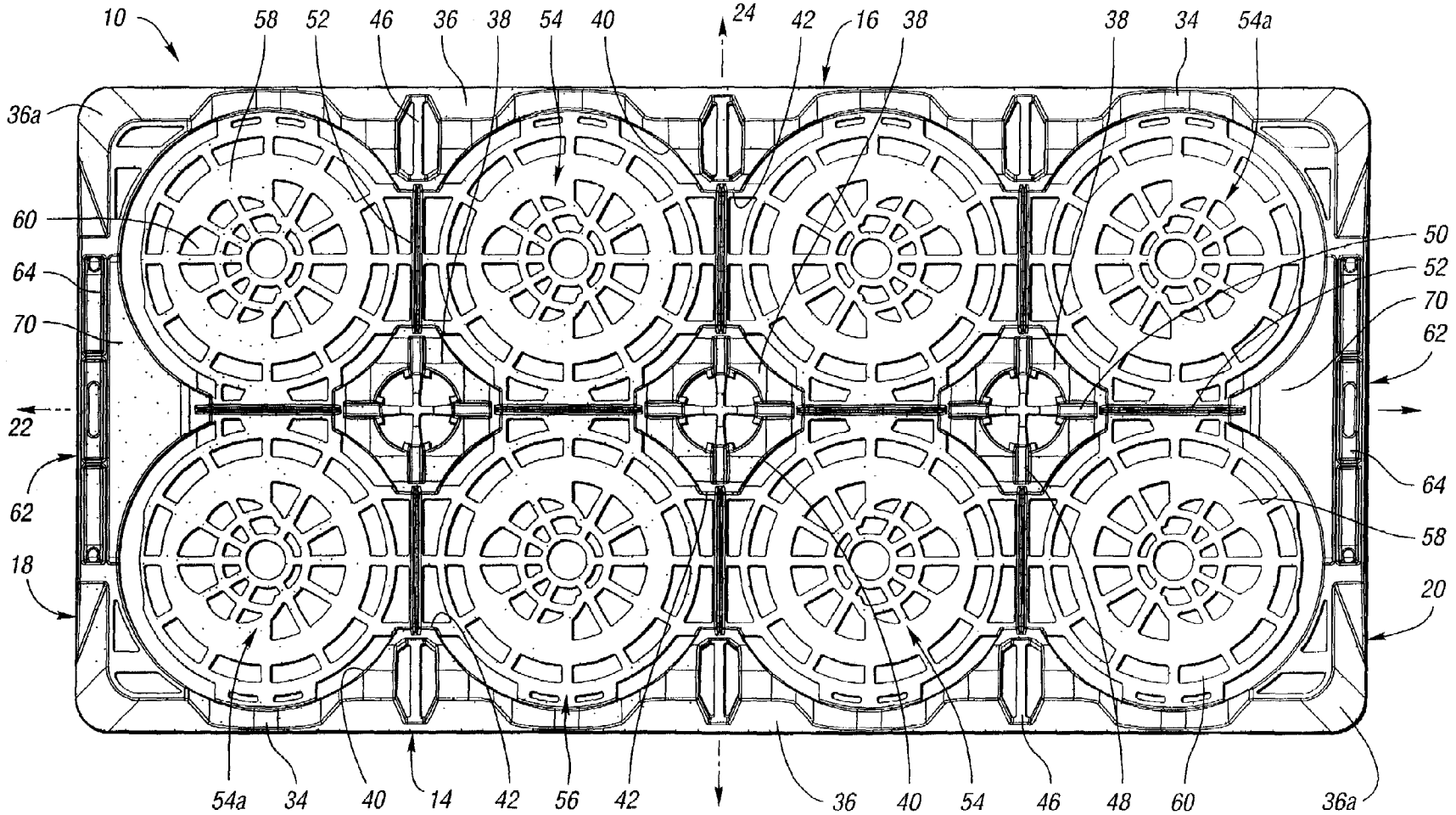
FIG. 2 is a top plan view of the tray.

In a preferred embodiment, side walls 14, 16 and end walls 18, 20 have double-walled construction which ensures the requisite strength and rigidity for transport and handling. Referring to FIGS. 1-2, side walls 14, 16 include a lower wall portion 26 having a substantially flat outer wall 28 and a generally curved inner wall 30 which is contoured to the shape of bottles B loaded with tray 10 (see FIG. 10). Side walls 14, 16 further include an upper wall portion 32 which includes windows 34 formed therein as shown in FIG. 1 and in the side elevational view of FIG. 4. Windows 34 are preferably generally semicircular, although other shapes are fully contemplated. As shown in FIG. 8, windows 34 allow for increased visibility of bottles B stored within tray 10, and also reduce the weight of tray 10.

Referring again to FIGS. 1 and 4-5, upper wall portion 32 of side walls 14, 16 further includes a plurality of wall pylons 36 projecting upwardly between windows 34 and integrally formed with lower wall portion 26. It will be understood in the present invention that "pylon" denotes an upwardly extending hollow member associated with side walls 14, 16 or end walls 18, 20. In addition to wall pylons 36, a corner pylon **36*a* is disposed in each corner of tray 10 at the intersection of adjacent side walls 14, 16 and end walls 18, 20. Pylons 36, 36*a* preferably extend a distance above base 12 of approximately 40% of the height of bottles B loaded in tray 10 (see FIG. 8). In this way, upper wall portion 32 provides a stabilizing structure which still maintains high bottle visibility and reduces manufacturing costs. To facilitate stacking of empty trays 10, outer faces of pylons 36, 36*a* are tapered so that the cross-section at the top is smaller than the cross-section near lower wall portion 26 and are slightly angled toward the interior of tray 10**.

In addition to pylons 36, 36*a*, one or more upwardly projecting interior columns 38 are disposed away from side walls 14, 16 and end walls 18, 20 along the longitudinal axis 22 of tray 10 (best shown in FIG. 1). For clarity of the present invention, "columns" denote upwardly extending hollow members within the interior area of tray 10. As shown, interior columns 38 are lower in height than wall pylons 36 and corner pylons 36*a*, preferably extending a distance above base 12 of approximately 28% of the height of the bottles B loaded in the tray. As such, columns 38 preferably have a height of approximately 75% of the height of pylons 36, 36*a* for providing adequate lateral support for the loaded bottles B. Lower height interior columns 38 reduce the weight of tray 10, and also require less mold time and promote faster and more even cooling. In addition to facilitating an increase in the number of mold cycles which are possible within a given time period, faster and more even cooling alleviates warping concerns and may additionally increase the life of tray 10. Importantly, due to the height of pylons 36, 36*a* relative to bottles loaded in tray 10, the reduced height of interior columns 38 neither compromises the structural integrity of tray 10 nor results in any loss in bottle stability compared with prior art trays.

Pylons 36, 36*a* and columns 38 are substantially hollow for reduced tray weight and also to permit empty trays 10 to stack as described below with reference to FIGS. 8-10. Pylons 36, 36*a* each include at least one curved surface 40 contoured to the shape of bottles loaded in the tray. Interior columns 38 are preferably substantially octagonal in shape, having alternating curved surfaces 40 and flat surfaces 42. Corner pylons 36*a* have one curved surface 40, while wall pylons 36 disposed on side walls 14, 16 have two curved surfaces 40 and one flat surface 42 disposed therebetween. Furthermore, each pylon 36, 36*a* and column 38 preferably includes an opening 44 on the curved surfaces 40 thereof adjacent base 12 for reducing the weight of tray 10 and allowing the stacking of pylons 36, 36*a* and columns 38 as described below.

Figure 4:
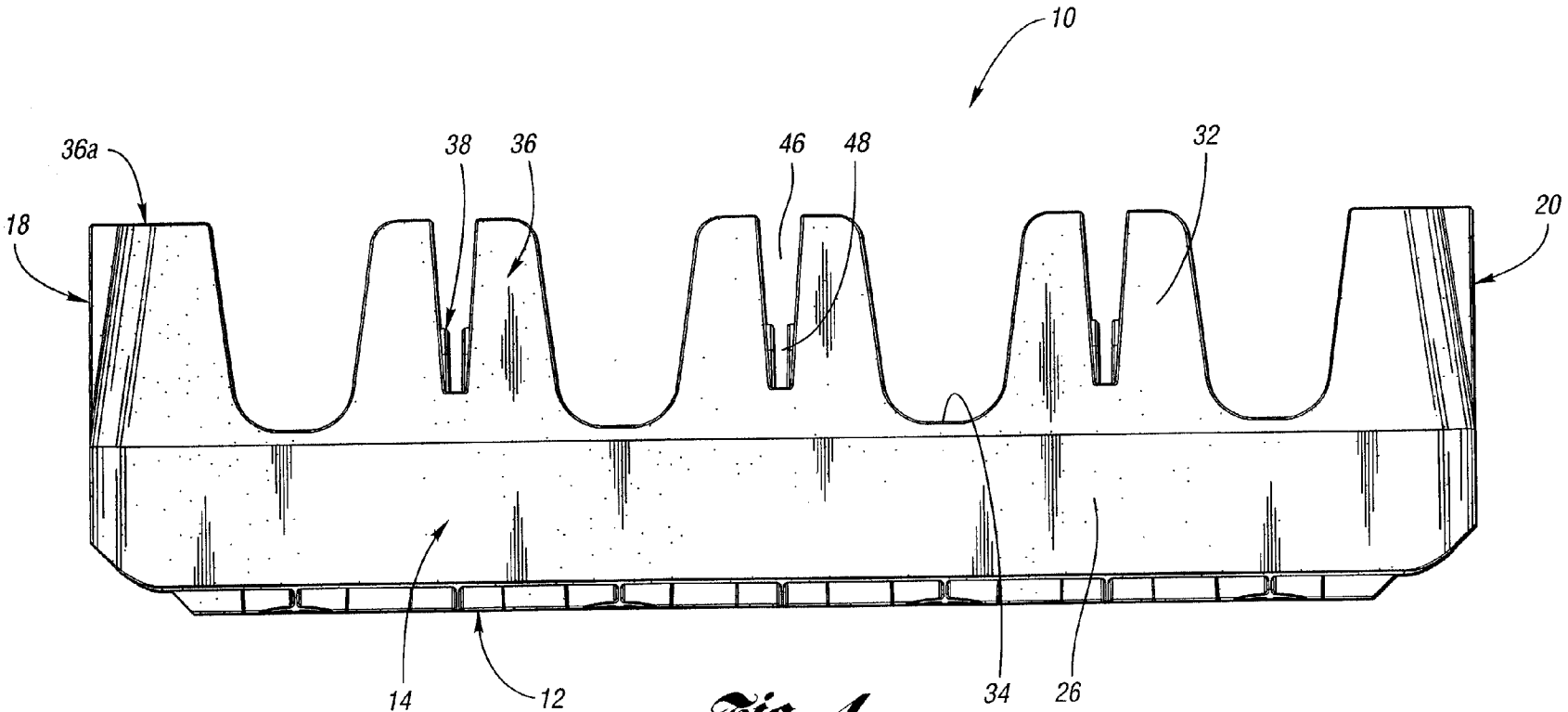
FIG. 4 is a front side elevational view of the tray, the rear side being a mirror image thereof.

Referring now to FIGS. 1-2 and 4, wall pylons 36 each include a downwardly extending recess 46 formed therein. Correspondingly, interior columns 38 each include a downwardly extending transverse recess 48 substantially aligned with recesses 46 in adjacent pylons 36, and a downwardly extending longitudinal recess 50 extending along the longitudinal axis 22 of tray 10. Pylon recesses 46 and interior column recesses 48, 50 extend downwardly to substantially the same depth, slightly above lower wall portion 26. As described below with reference to FIGS. 8-10, recesses 46, 48, 50 facilitate the stacking of empty trays 10.

Figure 6:
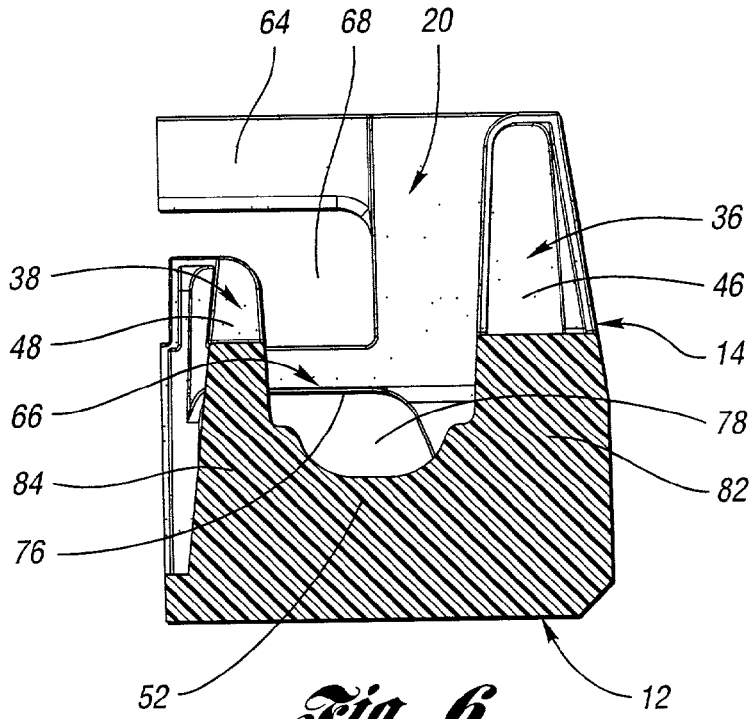
FIG. 6 is a cross-sectional view of the tray taken along line 6-6 of FIG. 1.
Figure 7:
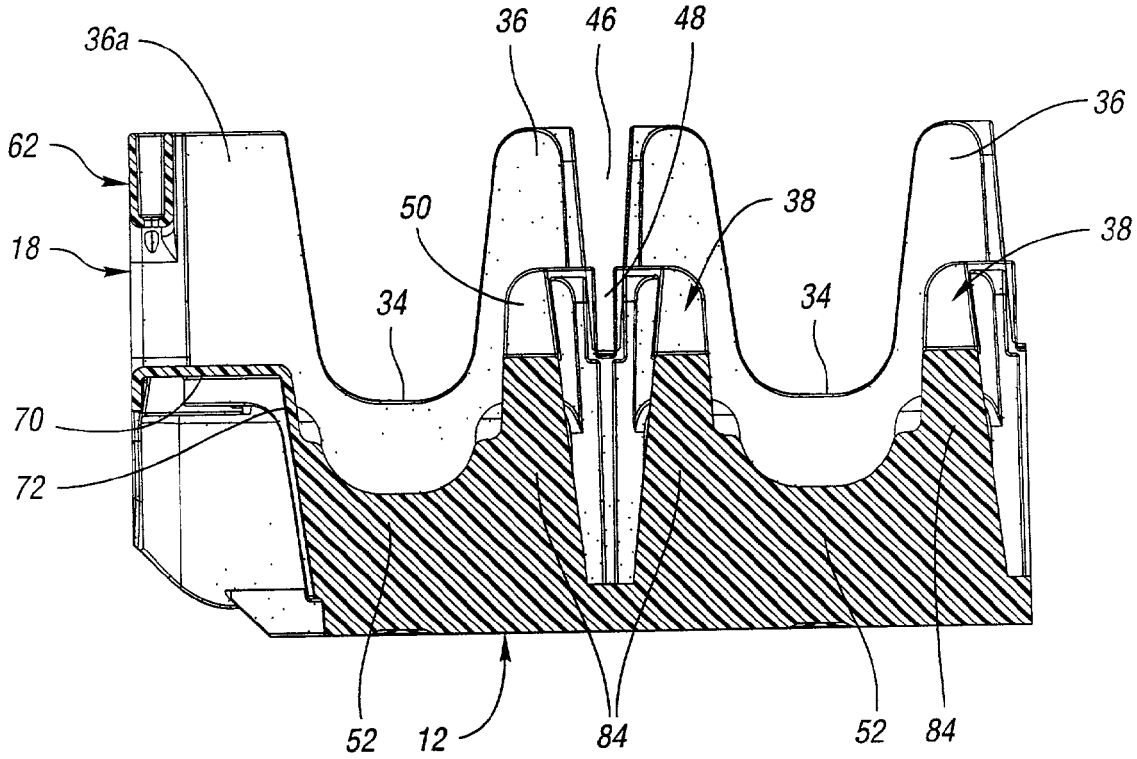
FIG. 7 is a cross-sectional view of the tray taken along line 7-7 of FIG. 1.

Still further, as best shown in FIGS. 1 and 4 and the cross-sectional views of FIGS. 6-7, tray 10 includes a plurality of interior divider walls 52 of single-walled construction which project upwardly from base 12 and extend between adjacent pylons 36 and columns 38 to form an interior support structure and secure pylons 36 and columns 38 to base 12. Divider walls 52 are generally flat and preferably do not extend above lower wall portion 26.

Together, divider walls 52, pylons 36, 36*a*, columns 38, base 12, side walls 14, 16, and end walls 18, 20 define a plurality of bottle retaining pockets 54, 54*a* having substantially equal center-to-center distances. Each pocket 54, 54*a* includes at least one pylon 36, 36*a*, at least one column 38, and at least one divider wall 52 and is sized to receive a single bottle therein. In greater specificity, the four curved surfaces 40 of each interior column 38 define portions of four bottle retaining pockets 54, 54*a* and the four flat surfaces 42 separate these pockets 54 and are generally attached to and have a centerline coplanar with that of divider walls 52. The two curved surfaces 40 of each wall pylon 36 help define two separate and adjacent bottle retaining pockets 54, 54*a*, with the flat surface 42 disposed between these two bottle retaining pockets 54, 54*a*. Lastly, the single curved surface 40 of corner pylons 36*a* belong to only one bottle retaining pocket 54*a*. As such, four curved surfaces 40 on four separate pylons 36, 36*a* or columns 38 form the four corners of a bottle retaining pocket 54. However, bottle retaining pockets 54*a* adjacent end walls 18, 20 are an exception to this configuration, as will be discussed below.

The ratio of the length of side walls 14, 16 to the length of end walls 18, 20 in tray 10 according to the present invention is substantially equal to the ratio of the number of bottle retaining pockets 54, 54*a* in the lengthwise direction to the number of bottle retaining pockets 54, 54*a* in the widthwise direction. For example, the 8-bottle tray 10 depicted herein is twice as long as it is wide and holds bottles in a 4×2 relationship. In addition, bottle retaining pockets 54, 54*a* of tray 10 are sized to receive two-liter bottles, as shown in FIGS. 8-11. Of course, tray 10 according to the present invention can be designed to retain any number of bottles and any size of bottles.

Referring now to the top plan view of FIG. 2, base 12 includes an upper surface 56 including a plurality of spaced bottle support areas 58, where each bottle support area 58 forms part of one bottle retaining pocket 54, 54*a*. Bottle support areas 58 are generally circular and are preferably substantially flat to permit retention of bottles regardless of the configuration of the bottom of the bottles, and to permit rotation of bottles of all types within bottle retaining pockets 54, 54*a* to facilitate display of the product through windows 34. Alternatively, bottle support areas 58 could be formed with small depressions or projections (not shown) corresponding to the locations and configurations of the bottoms of the bottles to be retained within each of the bottle retaining pockets 54, 54*a*.

Bottle support areas 58 are joined to side walls 14, 16 and divider walls 52 included in each bottle retaining pocket 54, 54*a*. Bottle retaining pockets 54, 54*a* of the present invention provide support and stability for the bottles B loaded in tray 10, such that excess movement of the bottles is avoided in order to ensure that the bottles remain in a vertically upright position to most advantageously bear the load of bottles stacked or cross-stacked above. As best shown in FIG. 2, bottle support areas 58 preferably have a configuration with a plurality of apertures 60 formed therein. These apertures 60 provide a lightweight tray, and are practical for allowing any liquids to drain through base 12. Of course, bottle support areas 58 could include any design suitable for supporting bottles.

Figure 5:
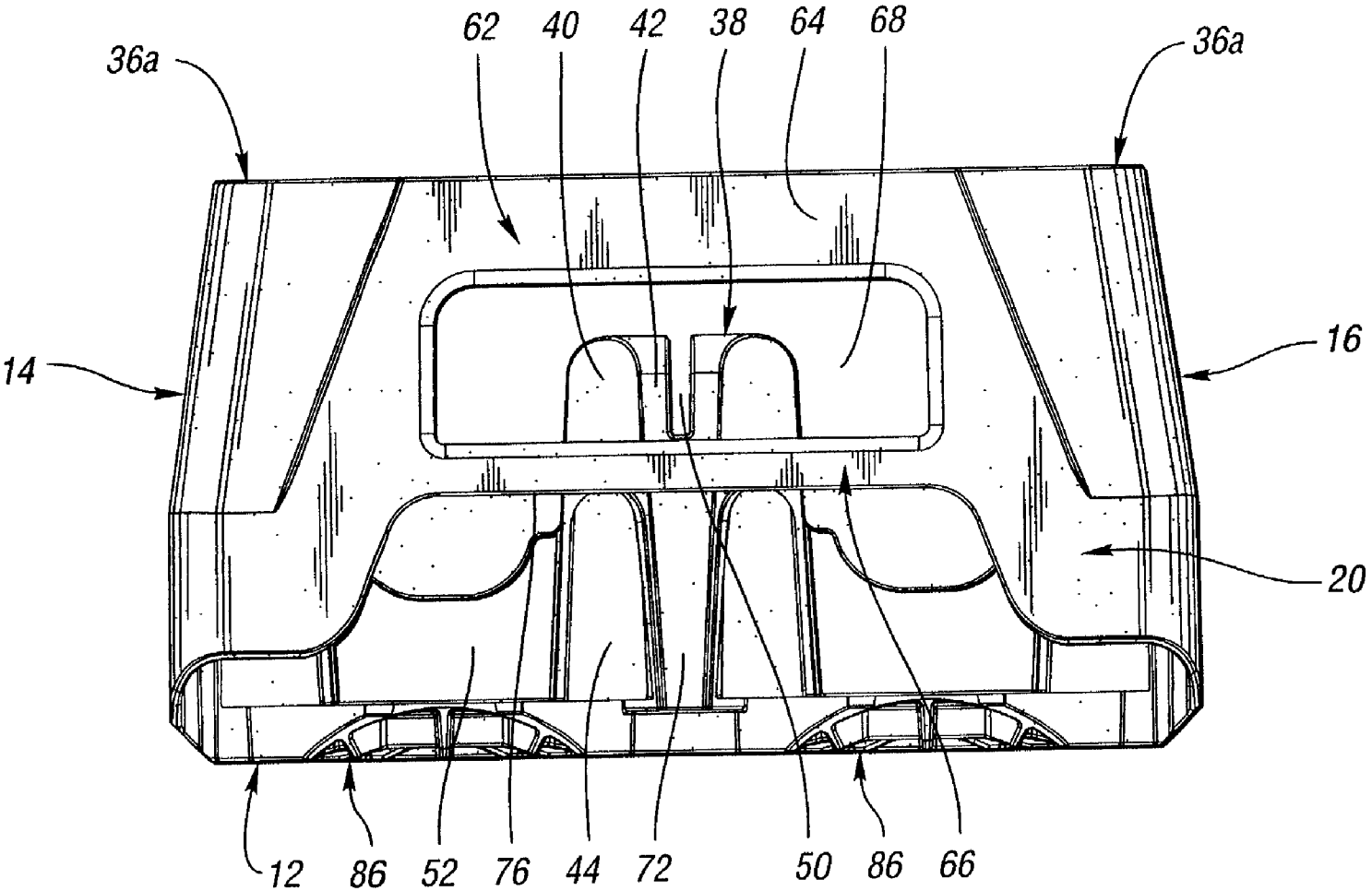
FIG. 5 is a right end elevational view of the tray, the left end being a mirror image thereof.

Referring now to FIGS. 1 and 5, end walls 18, 20 each include a handle structure 62 formed therein to facilitate carrying tray 10. Each handle structure 62 includes an upper bar 64 and a lower support member 66 which define a handle opening or slot 68 therebetween through which a user can extend his/her hand. Upper bars 64 are supported by adjacent corner pylons 36*a* and are positioned at a height substantially equal to that of corner pylons 36*a*. Upper bars 64 are preferably outwardly offset from corner pylons 36*a* as shown to enhance hand clearance when the tray 10 is filled with bottles. In a further embodiment of the invention, upper bars 64 may also have finger recesses (not shown) along the lower edge thereof to further aid in carrying tray 10.

Figure 9:
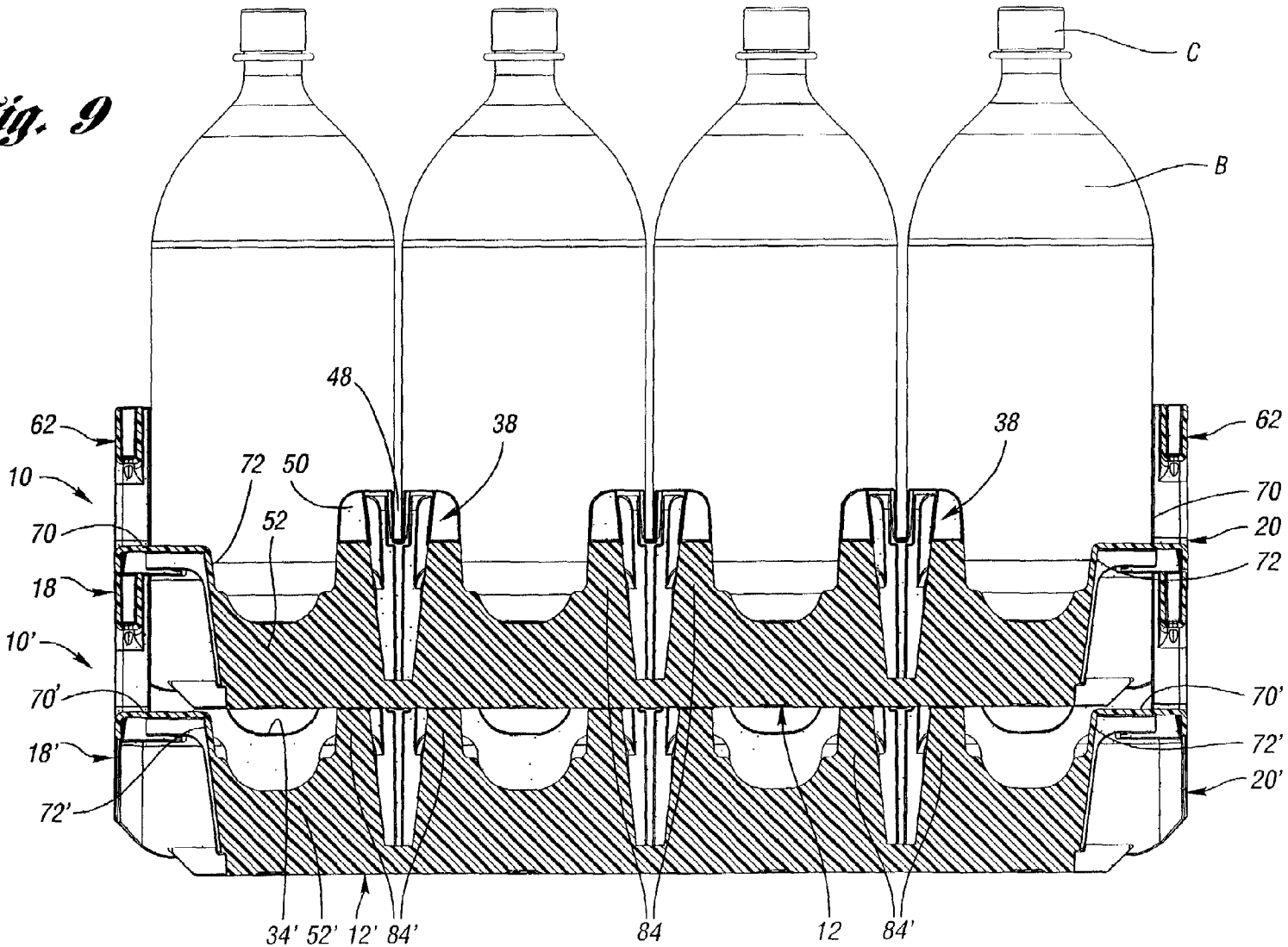
FIG. 9 is a cross-sectional view of the trays of FIG. 8 taken along line 9-9.
Figure 10:
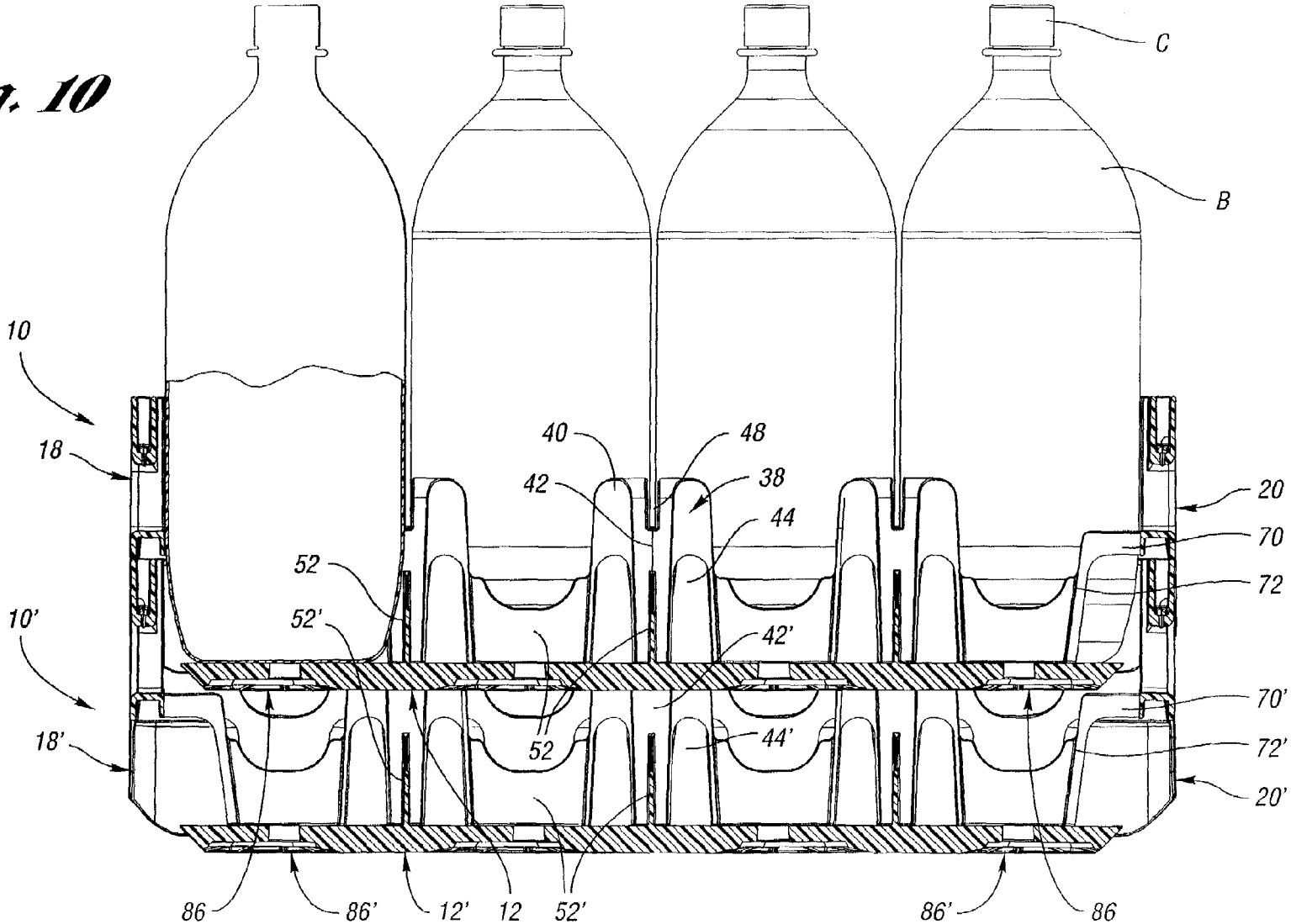
FIG. 10 is a cross-sectional view of the trays of FIG. 8 taken along line 10-10.

Each lower support member 66 includes a generally triangular horizontal portion 70 which is connected to adjacent corner pylons 36*a* and extends inwardly into tray 10, and a generally vertical portion 72 which extends downwardly to join with adjacent interior divider wall 52 and base 12 (best shown in FIGS. 1, 7, and 9). Therefore, handle structure 62 is structurally connected to base 12 for structural reinforcement and stability of tray 10. Horizontal portion 70 includes curved surfaces 74 which are contoured to the shape of bottles loaded in tray 10 and form part of bottle retaining pockets 54*a* adjacent end walls 18, 20. Lower support members 66 further include a bottom edge 76 bordering a cutout portion 78 at the bottom of each end wall 18, 20 adjacent base 12, wherein cutout portion 78 allows for the stacking of trays 10 and further reduces the weight of tray 10.

As shown in FIG. 1, the area immediately interior to slot 68 is hollow in order to ensure sufficient hand clearance and to prevent interference with the grasping of upper bar 64. With this handle configuration, a user's fingers can be inserted through slot 68 and under upper bar 64 in a palm-up orientation, or over upper bar 64 and through slot 68 in a palm-down orientation. The palm-up orientation may be preferred when tray 10 is on the ground, while the palm-down orientation may be preferred when tray 10 is stacked above an operator's head. Providing an operator with the option of handling tray 10 in either hand orientation enables easier manipulation of tray 10. The importance of this feature can be appreciated when tray 10 is loaded with bottles B, as shown in FIG. 8.

In addition to handle structures 62 provided on end walls 18, 20, handles or an alternate handle configuration may be provided on side walls 14, 16 such that a gripping structure is disposed on each side of tray 10 for removing cross-stacked trays 10 from a pallet, since some of the cross-stacked trays 10 will have end walls 18, 20 facing the operator and some of the cross-stacked trays 10 will have side walls 14, 16 facing the operator.

Figure 3:
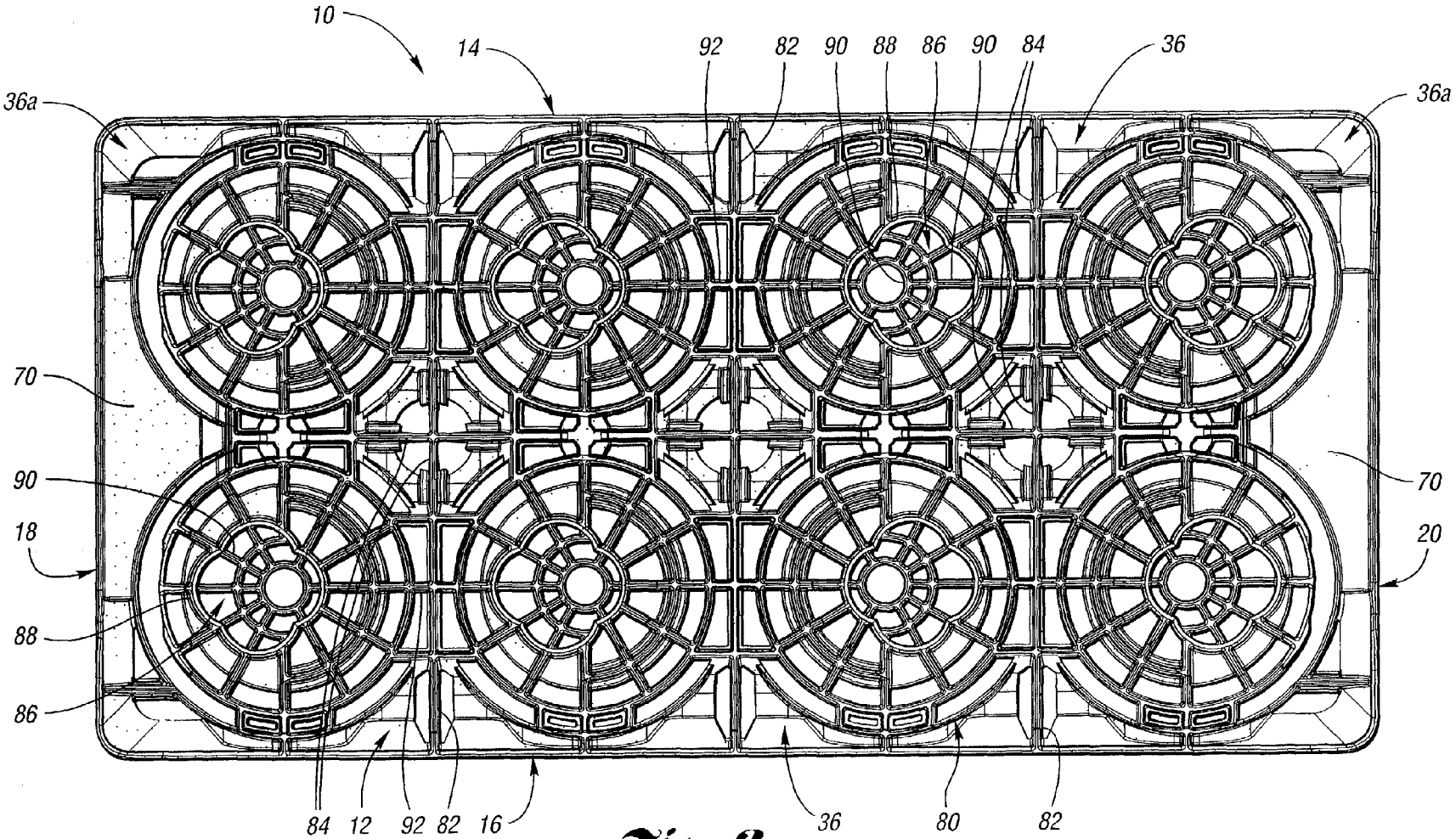
FIG. 3 is a bottom plan view of the tray.

Turning next to the bottom plan view of FIG. 3, base 12 has a lower surface 80 which includes a plurality of pylon support ribs 82 extending upwardly from lower surface 80 to abut each pylon recess 46. Likewise, a plurality of column support ribs 84 extend upwardly from lower surface 80 to abut both transverse column recesses 48 and longitudinal column recesses 50. Ribs 82, 84 provide structural support for tray 10 and also reduce open areas in base lower surface 80 to avoid catching bottle closures C therein, thereby facilitating the sliding of a top tray 10 along a loaded lower tray. Recesses 46, 48, 50 accommodate ribs 82, 84 to enable empty trays 10 to be column stacked as shown in the perspective view of FIG. 8 and the cross-sectional views of FIGS. 9-10. In FIGS. 8-10, elements of lower like tray or trays 10' are given like reference numerals to corresponding elements in upper tray or trays 10 except for the addition of a prime (') designation. When an upper tray 10 is disposed in a stacked configuration with an empty, like lower tray 10', pylon recesses 46' of lower tray 10' are adapted to receive corresponding pylon ribs 82 of upper tray 10 and column recesses 48', 50' of lower tray 10' are adapted to receive corresponding column ribs 84 of upper tray 10. In this way, the substantially hollow pylons 36, 36*a* and columns 38 of upper tray 10 receive at least a portion of respective pylons 36', 36*a'* and columns 38' of like lower tray 10', wherein the depth of recesses 46', 48', 50' determines the stacking height of trays 10, 10'.

Referring again to the bottom plan view of FIG. 3, base lower surface 80 is also configured to allow for stable stacking and cross-stacking of loaded trays 10. Cross-stacking is done by rotating a top tray 90 degrees about a vertical axis and lowering it onto a lower tray or trays. Cross-stacking is often used to improve the stability of trays of bottles loaded on a warehouse pallet. In a cross-stacked structure, each layer has trays oriented parallel to each other with the trays in adjacent layers being oriented at right angles to each other. Since each tray in the cross-stacked layer rests on at least two trays in the layer below, the trays of the cross-stacked layer tend to keep the trays on which they rest from moving apart from each other, thereby stabilizing the structure.

Still referring to FIG. 3, base lower surface 80 is formed as a plurality of upwardly recessed closure receiving areas 86 sized to receive the bottle closures C of bottles which are disposed in a lower tray 10'. Receiving areas 86 of base lower surface 80 generally oppose bottle support areas 58 of base upper surface 56, and correspond in number to the number of bottles B that tray 10 is designed to retain. When an upper tray 10 is loaded with bottles B and disposed in a stacked configuration with a like lower tray 10' (not shown), bottle retaining pockets 58 of upper tray 10 are substantially aligned with bottle retaining pockets 58' of like lower tray 10', such that the bottles B are generally coaxially aligned with each other.

However, the positioning of handle structures 62 in the present invention results in unequal center-to-center distances between end bottle retaining pockets 54*a* in adjacent trays 10 with abutting end walls 18, 20, such that bottle closures C of the cross-stacked upper tray 10 do not align with bottle closures C in trays 10' therebelow. Taking the non-equidistant end pockets into consideration, the present invention utilizes a closure receiving area 86 to accommodate all possible positions of the bottle closures C when a plurality of like trays 10, 10' are stacked and cross-stacked. Specifically, receiving areas 86 are defined by a downwardly extending periphery 88, preferably generally cloverleaf-shaped as shown, and a plurality of interconnected ribs 90. Each periphery 88 is positioned to provide a range within which the bottle closures C in a loaded lower tray 10' may reside while substantially restraining side-to-side and end-to-end movement of bottles B in order to retain loaded trays 10, 10' in a stacked or cross-stacked arrangement even though bottles B are not necessarily coaxially aligned with each other. Base lower surface 80 further includes ribs 92 connecting receiving areas 86 to each other which allow bottle closures C to slide easily along lower surface 80 between receiving areas 86. Therefore, once the bottle closures C are disengaged from receiving areas 86 (i.e., their stacked or cross-stacked positions), tray 10 may slide along the bottle closures C in a similar lower tray 10' to facilitate handling.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low depth tray for bottles, comprising:

a first pair of opposed walls;

a second pair of opposed walls attached to the first pair of opposed walls to form a wall structure having an interior, the second pair of opposed walls shorter than the first pair of opposed walls;

a base attached to the wall structure;

a plurality of interior divider walls extending upwardly from the interior of the wall structure; and at least one interior member projecting upwardly from the interior of the wall structure and connected to at least one divider wall, the at least one interior member having a height less than an uppermost height of the first pair of opposed walls and less than the height of bottles loaded in the tray, wherein the at least one interior member, the base, the divider walls, and the wall structure define a plurality of bottle retaining pockets which are each sized to receive a single bottle therein.

2. The tray according to claim 1, wherein the wall structure includes an upper wall portion having a plurality of upwardly projecting wall members.

3. The tray according to claim 2, wherein the upper wall portion includes a plurality of windows formed therein between the wall members.

4. The tray according to claim 2, wherein the wall members and the at least one interior member are substantially hollow.

5. The tray according to claim 2, wherein each wall member includes at least one curved surface contoured to the shape of bottles loaded in the tray, and wherein the at least one interior member is generally octagonal and includes curved surfaces disposed on alternating sides thereof which are contoured to the shape of bottles loaded in the tray.

6. The tray according to claim 5, wherein the wall members and the at least one interior member each include an opening adjacent the base on the curved surfaces thereof.

7. The tray according to claim 1, wherein the wall structure has a double-walled construction and includes a lower wall portion having a substantially flat outer wall and a generally curved inner wall.

8. The tray according to claim 2, wherein the plurality of wall members includes side wall members disposed along the first pair of opposed walls and four corner members disposed at the intersection of adjacent walls.

9. The tray according to claim 8, wherein the side wall members each include a downwardly extending recess formed therein.

10. The tray according to claim 9, wherein the at least one interior member includes a downwardly extending transverse recess substantially aligned with the recesses in adjacent side wall members, and a downwardly extending longitudinal recess extending along a longitudinal axis of the tray, wherein the depth of the interior member recesses is substantially equal to the depth of the side wall member recesses.

11. The tray according to claim 10, wherein the base has a lower surface which includes a plurality of side wall member support ribs extending upwardly from the lower surface to join with each side wall member recess, and a plurality of column support ribs extending upwardly from the lower surface to join with the transverse and longitudinal column recesses.

12. The tray according to claim 8, wherein each of the second pair of opposed walls includes a handle structure, each handle structure including an upper bar extending between adjacent corner members, a lower support member connected to the corner members and the base, and a slot defined therebetween, wherein a user's fingers can be inserted through the slot and under the upper bar in a palm-up orientation, and over the upper bar and through the slot in palm-down orientation.

13. The tray according to claim 12, wherein the upper bar and the corner members are substantially equal in height, and the upper bar is outwardly offset from the corner members.

14. The tray according to claim 12, wherein the lower support member includes a generally horizontal portion which is connected to the corner members and extends inwardly into the tray, and a generally vertical portion which extends downwardly from the horizontal portion to join with the base.

15. The tray according to claim 14, wherein the horizontal portion includes curved surfaces which are contoured to the shape of bottles loaded in the tray and form part of bottle retaining pockets located adjacent the second pair of opposed walls.

16. The tray according to claim 1, wherein the base includes an upper surface including a plurality of spaced bottle support areas joined to the first pair of opposed walls, wherein each bottle support area is generally circular and forms part of one bottle retaining pocket.

17. The tray according to claim 16, wherein the bottle support areas include apertures formed therein.

18. The tray according to claim 1, wherein the base includes a lower surface having upwardly recessed closure receiving areas configured to receive and retain bottle closures of a lower like tray therein.

19. The tray according to claim 1, wherein the bottle retaining pockets are sized to receive two-liter bottles.

20. A low depth tray for storing and transporting bottles, comprising:

a base;

a unitary wall structure extending upwardly from the base, the wall structure having an upper wall portion including a plurality of windows formed therein and a plurality of upwardly projecting pylons disposed between the windows; and an interior support structure disposed within the wall structure and connected thereto, the interior support structure including a plurality of divider walls extending upwardly from the base and a plurality of spaced interior columns projecting upwardly from the base and interconnected by the divider walls, the interior columns having a height less than the height of the pylons and less than the height of bottles loaded in the tray;

wherein the interior support structure, the wall structure, and the base together define a plurality of bottle retaining pockets, and the pylons and the interior columns each include at least one curved surface adapted to contact bottles received in the bottle retaining pockets.

21. The tray according to claim 20, wherein the pylons and columns are substantially hollow.

22. The tray according to claim 20, wherein outer faces of the pylons are tapered from bottom to top and are angled slightly toward the interior of the tray.

23. The tray according to claim 20, wherein the interior columns are generally octagonal and include curved surfaces disposed on alternating sides thereof which are contoured to the shape of bottles loaded in the tray.

24. The tray according to claim 20, wherein the wall structure has a double-walled construction and includes a lower wall portion having a substantially flat outer wall and a generally curved inner wall which is adapted to contact bottles received in the bottle retaining pockets.

25. The tray according to claim 20, wherein the wall structure includes a pair of opposed side walls joined to a pair of opposed end walls, and the plurality of pylons includes wall pylons disposed along the side walls and four corner pylons disposed at the intersection of adjacent side walls and end walls.

26. The tray according to claim 20, wherein the wall pylons each include a downwardly extending recess formed therein, and the interior columns each include a downwardly extending transverse recess substantially aligned with the recesses in adjacent wall pylons, and a downwardly extending longitudinal recess extending along a longitudinal axis of the tray, wherein the depth of the column recesses is substantially equal to the depth of the pylon recesses.

27. The tray according to claim 26, wherein the base has a lower surface which includes a plurality of pylon support ribs extending upwardly from the lower surface to join with each pylon recess, and a plurality of column support ribs extending upwardly from the lower surface to join with the transverse and longitudinal column recesses.

28. The tray according to claim 25, wherein each of the end walls includes a handle structure, each handle structure including an upper bar extending between adjacent corner pylons, a lower support member connected to the corner pylons and the base, and a slot defined therebetween, wherein a user's fingers can be inserted through the slot and under the upper bar in a palm-up orientation, and over the upper bar and through the slot in palm-down orientation.

29. The tray according to claim 20, wherein the base includes an upper surface including a plurality of spaced bottle support areas joined to the wall structure and the divider walls, wherein each bottle support area is generally circular and forms part of one bottle retaining pocket.

30. The tray according to claim 20, wherein the base includes a lower surface having upwardly recessed closure receiving areas, the receiving areas each having a downwardly extending, generally cloverleaf-shaped periphery configured to receive and retain bottle closures therein.

31. The tray according to claim 20, wherein the bottle retaining pockets are sized to receive two-liter bottles.

32. The tray according to claim 20, wherein the columns have a height of approximately 75% of the height of the pylons.

33. The tray according to claim 20, wherein the pylons extend a distance above the base of approximately 40% of the height of bottles loaded in the tray.

34. A plastic low depth tray for bottles, comprising:

a base having an upper surface and a lower surface, the upper surface including a plurality of spaced, generally circular bottle support areas;

a pair of opposed end walls extending upwardly from the base, each end wall including a handle structure formed therein;

a pair of opposed side walls extending upwardly from the base and integrally joined with the pair of opposed end walls, wherein the side and end walls are of double-walled construction and include a lower wall portion and an upper wall portion, the lower wall portion having a substantially flat outer wall and a generally curved inner wall, and the upper wall portion having a plurality of windows formed therein and a plurality of spaced pylons projecting upwardly from the lower wall portion between the windows;

a plurality of spaced upwardly projecting interior columns disposed along a longitudinal axis of the tray and having a height less than the height of the pylons and less than the height of bottles loaded in the tray; and a plurality of divider walls extending upwardly from the base and interconnecting the pylons and interior columns, wherein the base, side walls, end walls, interior columns, and divider walls together define a plurality of bottle retaining pockets, each pocket including one bottle support area for supporting a base of each bottle and at least one pylon, column, and divider wall for providing lateral support for each bottle.

35. A stackable low depth tray for storing and transporting bottles, comprising:

a base;

a pair of opposed end walls extending upwardly from the base;

a pair of opposed side walls extending upwardly from the base and integrally joined with the pair of opposed end walls to form a wall structure, the side walls including a plurality of spaced, upwardly extending hollow wall pylons, each of the wall pylons having a downwardly extending recess formed therein which is associated with a corresponding pylon support rib;

a plurality of spaced, upwardly extending hollow interior columns disposed within the wall structure, the columns including downwardly extending transverse recesses substantially aligned with the recesses of adjacent wall pylons and downwardly extending longitudinal recesses extending along a longitudinal axis of the tray, each transverse recess and each longitudinal recess associated with a column support rib, wherein the interior columns have a height less than the height of the pylons and less than the height of bottles loaded in the tray; and a plurality of interior divider walls which join adjacent pylons and columns to form, in combination with the base and the wall structure, a plurality of bottle retaining pockets, wherein when the tray is empty and is disposed in a stacked configuration with a like upper tray, the pylon recesses of the tray are adapted to receive the corresponding pylon ribs of the like upper tray and the column recesses of the tray are adapted to receive the corresponding column ribs of the like upper tray, such that at least a portion of the pylons and columns of the tray are received in the pylons and columns, respectively, of the like upper tray.

36. A low depth tray for bottles, comprising:

a base;

a first pair of opposed walls;

a second pair of opposed walls each having a handle, the second pair of opposed walls attached to the first pair of opposed walls to form a wall structure;

a plurality of interior divider walls extending upwardly from the base within the wall structure; and at least one interior member projecting upwardly within the wall structure and connected to at least one divider wall, the at least one interior member having a height greater than the height of the divider walls but less than a greatest height of the first pair of opposed walls and less than the height of bottles loaded in the tray, wherein the at least one interior member, the base, the divider walls, and the wall structure together define a plurality of bottle retaining pockets.

* * * * *